US007750784B2

(12) United States Patent
Lee

(10) Patent No.: US 7,750,784 B2
(45) Date of Patent: Jul. 6, 2010

(54) INDUCTOR STRUCTURE

(75) Inventor: Sheng-Yuan Lee, Taipei Hsien (TW)

(73) Assignee: VIA Technologies, Inc., Taipei Hsien (TW)

( * ) Notice: Subject to any disclaimer, the term of this patent is extended or adjusted under 35 U.S.C. 154(b) by 0 days.

(21) Appl. No.: 12/339,629

(22) Filed: Dec. 19, 2008

(65) Prior Publication Data

US 2009/0096567 A1 Apr. 16, 2009

Related U.S. Application Data

(62) Division of application No. 11/771,098, filed on Jun. 29, 2007, now Pat. No. 7,489,218.

(30) Foreign Application Priority Data

Jan. 24, 2007 (TW) ..... 96102655 A
May 3, 2007 (TW) ..... 96115699 A

(51) Int. Cl.
*H01F 27/32* (2006.01)

(52) U.S. Cl. ..... 336/84 C; 336/200

(58) Field of Classification Search ..... 336/65, 336/84 R, 84 C, 200, 206–208, 232; 257/531
See application file for complete search history.

(56) References Cited

U.S. PATENT DOCUMENTS 5,539,241 A * 7/1996 Abidi et al. ..... 257/531
5,831,331 A * 11/1998 Lee ..... 257/659
6,611,041 B2 * 8/2003 Maeda et al. ..... 257/531
7,064,363 B2 * 6/2006 Lowther et al. ..... 257/277
7,084,728 B2 * 8/2006 Hyvonen ..... 336/84 C
2003/0096435 A1 * 5/2003 Acosta et al. ..... 438/3
2007/0069717 A1 * 3/2007 Cheung et al. ..... 324/158.1

FOREIGN PATENT DOCUMENTS

JP 11-016738 1/1999
TW 529046 4/2003
TW I246152 12/2005

OTHER PUBLICATIONS

Chinese Examination Report of Taiwan Application No. 096102655, dated Oct. 21, 2009.

* cited by examiner

*Primary Examiner*—Tuyen Nguyen
(74) *Attorney, Agent, or Firm*—J.C. Patents

(57) ABSTRACT

An inductor structure includes a winding turn layer, a shielding layer, and a number of vias. The winding turn layer disposed above a substrate is formed by a number of turns connected in series and t has a first end and a second end. The first end is grounded. The shielding layer disposed between the winding turn layer and the substrate has a third end and a fourth end. At least two turns starting from the first end of the winding turn layer are projected onto the shielding layer. The vias are disposed between the winding turn layer and the shielding layer to at least electrically connect the third end and the fourth end of the shielding layer to a first turn of the winding turn layer. The first turn starts from the first end, and the winding turn layer and the shielding layer are electrically coupled in parallel.

6 Claims, 11 Drawing Sheets

INDUCTOR STRUCTURE

CROSS-REFERENCE TO RELATED APPLICATION

This application is a divisional of an application Ser. No. 11/771,098, filed on Jun. 29, 2007, now allowed, which claims the priority benefit of Taiwan applications serial no. 96102655 and 96115699, filed on Jan. 24, 2007 and May 3, 2007, respectively. The entirety of each of the above-mentioned patent applications is hereby incorporated by reference herein and made a part of this specification.

BACKGROUND OF THE INVENTION

1. Field of the Invention

The present invention relates to an inductor structure. More particularly, the present invention relates to an inductor structure that can improve the value of Q.

2. Description of Related Art

Generally, as an inductor acquires energy storing and releasing functions through electromagnetic conversion, the inductor can be used as an element for stabilizing current. Further, the inductor can be widely utilized, for example, in a radio frequency (RF) circuit. In an integrated circuit (IC), the inductor is a very important but challenging element. For the performance of an inductor, the requirement on the quality of the inductor is high, i.e., the inductor must have a high quality factor, which is represented by a value of Q. The value of Q is defined as follows:

$$Q=\omega\times L/R$$

where ω is the angular frequency, L is the inductance of a coil, and R is the resistance at a specific frequency taking the inductance loss into consideration.

Currently, many methods and techniques are available to integrate inductors with IC processes. However, in an IC, the limitation on the thickness of the inductor conductor and the interference of the silicon substrate to the inductor will also lead to poor quality of the inductor. In the conventional art, a thick metal is disposed on the top of the inductor to reduce the conductor loss, so as to improve the value of Q of the inductor. However, when the thickness of the metal increases to certain extent, the improvement on the value of Q becomes unapparent. Further, as the inductor is often disposed near the silicon substrate, the parasitic capacitance generated between the silicon substrate and the inductor will increase, and the resistance of the inductor will increase accordingly. Thus, much energy must be consumed, and the quality of the inductor is degraded. As a result, it has become the key point of the vigorous development in the industry to solve the problems in the process to raise the value of Q of the inductor and reduce the conductor loss.

SUMMARY OF THE INVENTION

Accordingly, the present invention is directed to provide an inductor structure, which can reduce parasitic capacitance generated between a substrate and the inductor, and to reduce the conductor loss of the inductor, so as to raise a value of Q of the inductor.

The present invention further provides another inductor structure, including a winding turn layer, a shielding layer, and a plurality of vias. The winding turn layer, disposed above a substrate, is formed by a plurality of turns connected in series, and has a first end and a second end, in which the first end is grounded. The shielding layer, disposed between the winding turn layer and the substrate, has a third end and a fourth end. At least two turns starting from the first end of the winding turn layer are projected onto the shielding layer. The vias are disposed between the winding turn layer and the shielding layer, so as to at least make the third end and the fourth end of the shielding layer electrically be connected to a first turn of the winding turn layer. The first turn is starting from the first end, and the winding turn layer and the shielding layer are electrically coupled in parallel.

In order to make the aforementioned and other features and advantages of the present invention comprehensible, several embodiments accompanied with figures are described in detail below.

DESCRIPTION OF EMBODIMENTS

Figure 1A:
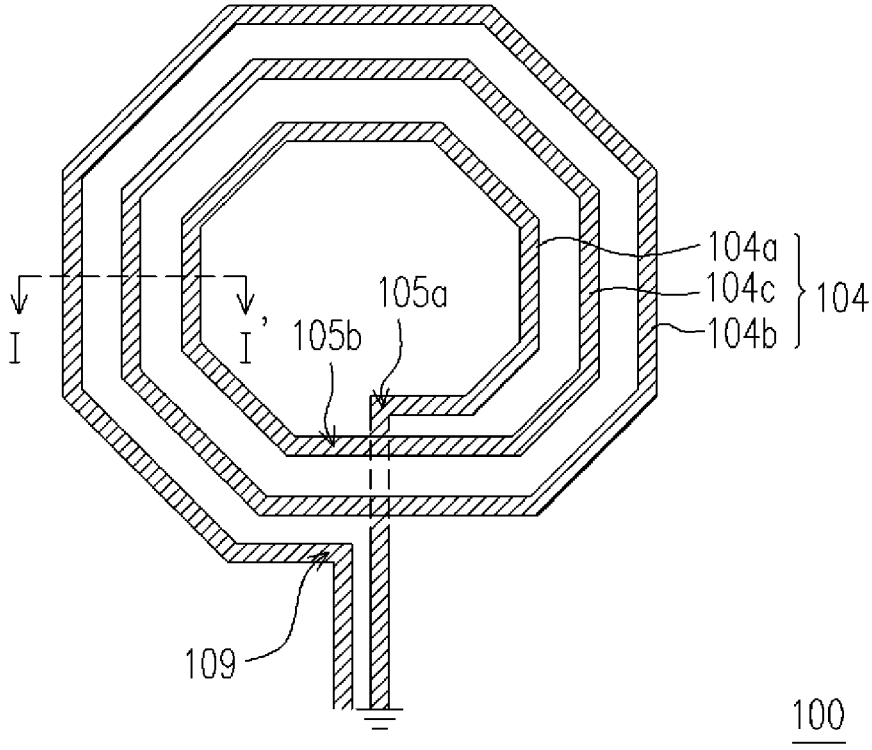
FIG. 1A is a top view of an inductor structure according to a first embodiment of the present invention.
Figure 1B:
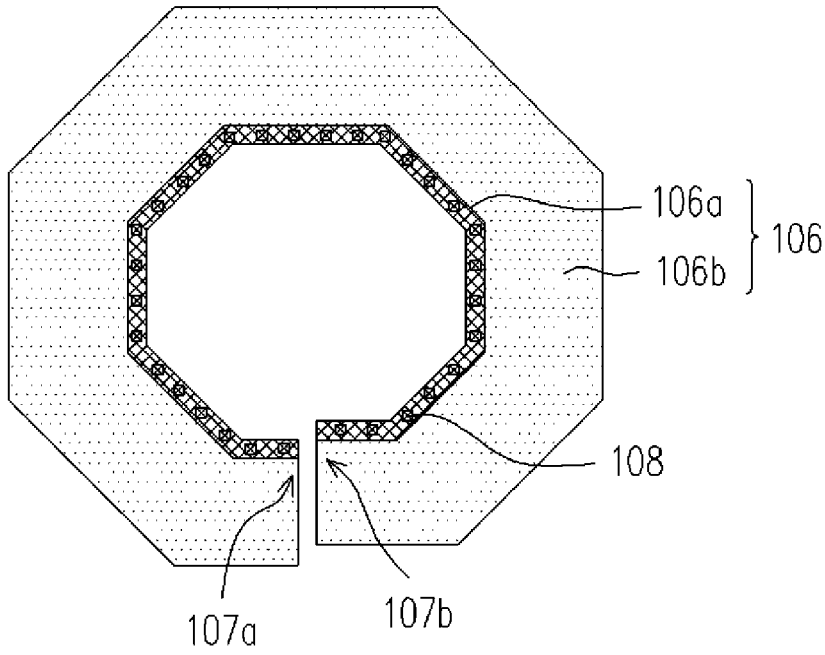
FIG. 1B is a top view of a shielding layer according to the first embodiment of the present invention.
Figure 1C:
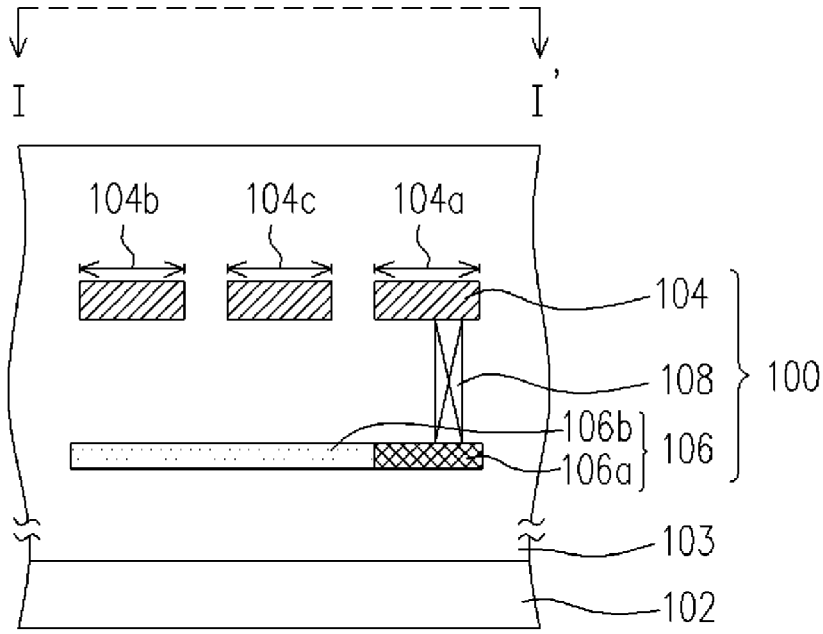
FIG. 1C is a schematic sectional view taken along a sectional line I-I' of FIG. 1A.

FIG. 1A is a top view of an inductor structure according to a first embodiment of the present invention. FIG. 1B is a top view of a shielding layer according to a first embodiment of the present invention. FIG. 1C is a schematic sectional view taken along a sectional line I-I' of FIG. 1A.

Firstly, referring to FIGS. 1A, 1B, and 1C together, the inductor structure 100 at least includes a winding turn layer 104 and a shielding layer 106, in which the winding turn layer 104 includes a plurality of turns. The winding turn layer 104 is disposed in a dielectric layer 103 above the substrate 102. The shielding layer 106 is disposed in the dielectric layer 103 between the winding turn layer 104 and the substrate 102. The substrate 102 is, for example, a silicon substrate. The material of the dielectric layer 103 is, for example, silicon oxide or other dielectric materials. The material of the winding turn layer 104 is metal, such as Cu or Al—Cu alloy. The material of the shielding layer 106 can be conductive materials, such as polysilicon or metal. As shown in FIG. 1A, in this embodiment, the inductor structure 100 is in the shape of an octagon, but the shape of the inductor structure of the present invention is not limited to the embodiments, and persons of ordinary skill in the art can make adjustments on demands.

In view of the above, the winding turn layer 104 is formed by a plurality of serially connected turns. Taking FIG. 1A for example, the winding turn layer 104 at least includes an inner turn (inner lead) 104*a*, an outer turn (outer lead) 104*b*, and an intermediate turn 104*c*. The inner turn 104*a* and the outer turn 104*b* are electrically coupled with each other through the intermediate turn (connection lead) 104*c* by means of, for example, series connection. An end 105*a* of the winding turn layer 104 (i.e., an end of the inner turn 104*a*) is, for example, grounded, and the other end 109 of the winding turn layer 104 (i.e., an end of the outer turn 104*b*) is, for example, electrically coupled to an operating voltage. In this embodiment, the winding turn layer 104 has 3.5 turns formed by the inner turn 104*a*, the outer turn 104*b*, and the intermediate turn 104*c*. However, the number of the turns of the winding turn layer 104 is not limited to 3.5 as shown in the embodiment, i.e., besides the inner turn 104*a* and the outer turn 104*b*, a plurality of intermediate turns 104*c* can be disposed between the inner turn 104*a* and the outer turn 104*b*. Persons of ordinary skill in the art can make appropriate adjustments on demands.

In another aspect, the shielding layer 106 is, for example, formed by a first pattern 106*a* and a second pattern 106*b*, which are, for example, integrally formed into a self-shielding structure (as shown in FIG. 1B). The first pattern 106*a* is disposed below the winding turn layer 104 at the position of the projection of the inner turn (grounded turn) 104*a*, so as to make a first turn (i.e., the inner turn 104*a*) starting from the end 105*a* projected onto the first pattern 106*a*. The first pattern 106*a* is electrically coupled to the inner turn 104*a* of the winding turn layer 104 by means of, for example, parallel connection. Moreover, at least two vias 108 are, for example, disposed between the winding turn layer 104 and the shielding layer 106, and an end 107*a* and an end 107*b* of the first pattern 106*a* are electrically coupled to the end 105*b* and the end 105*a* of the inner turn 104*a* respectively.

The second pattern 106*b* in the shielding layer 106 is next to the outer edge of the first pattern 106*a*, and at least one portion of the winding turn layer 104 is projected onto the second pattern 106*b*. For example, a second turn (i.e., the intermediate turn 104*c*) starting from the end 105*a* is projected onto the second pattern 106*b*. In other words, as long as the second pattern 106*b* shields a portion of the winding turn layer 104, the substrate 102 can be blocked from the winding turn layer 104, so as to reduce the parasitic capacitance generated between the substrate 102 and the inductor structure 100, i.e., the second pattern 106*b* has a shielding effect. As shown in FIG. 1C, in this embodiment, the winding turn layer 104 is completely projected onto the shielding layer 106. Under such circumstance, the shielding effect of the shielding layer 106 between the inductor structure 100 and the substrate 102 is better.

As the shielding layer 106 is disposed between the winding turn layer 104 and the substrate 102 to block the substrate 102 from the winding turn layer 104, the present invention can further reduce the occurrence of the parasitic capacitance generated between the substrate 102 and the inductor structure 100, thereby reducing the resistance caused by the substrate 102, and raising the value of Q of the inductor.

Figure 2A:
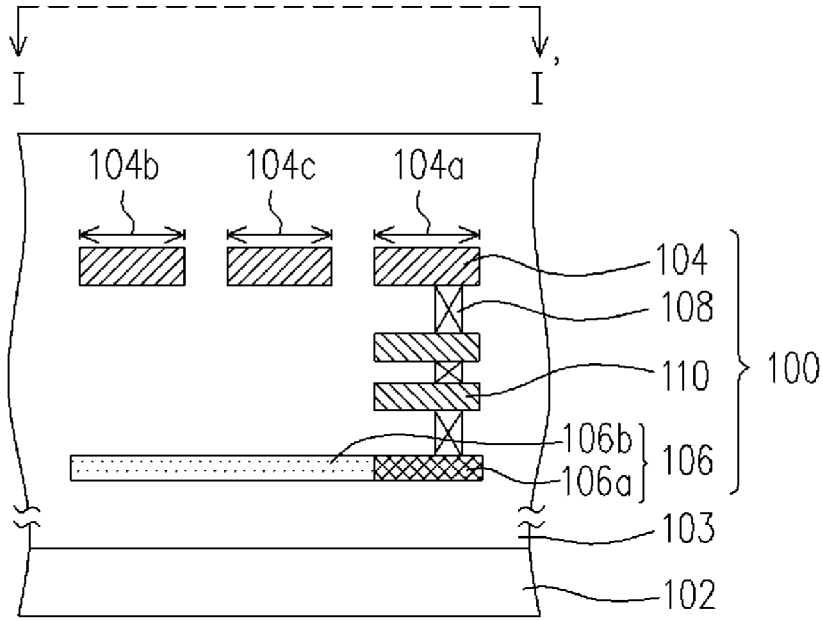
FIG. 2A is schematic sectional views taken along the sectional line I-I' of FIG. 1A according to a second embodiment of the present invention.
Figure 2B:
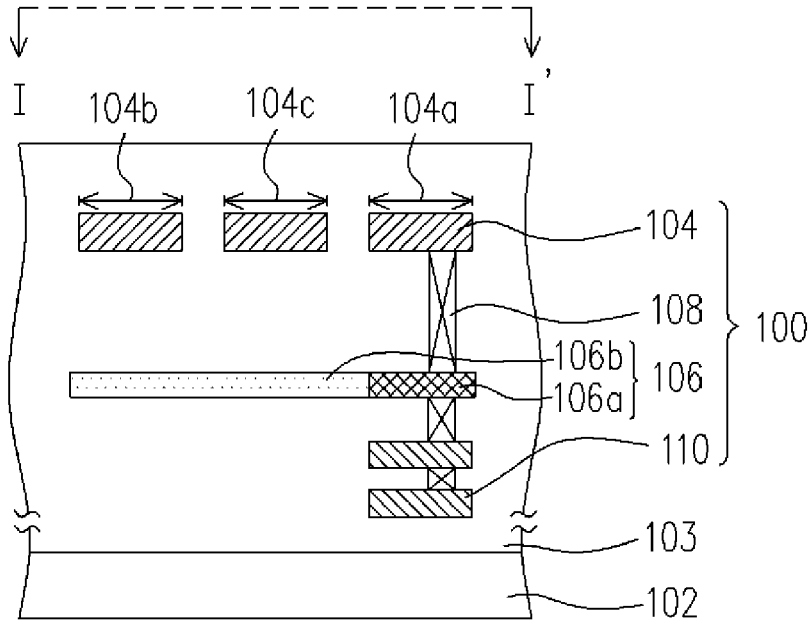
FIG. 2B is schematic sectional views taken along the sectional line I-I' of FIG. 1A according to a third embodiment of the present invention.
Figure 2C:
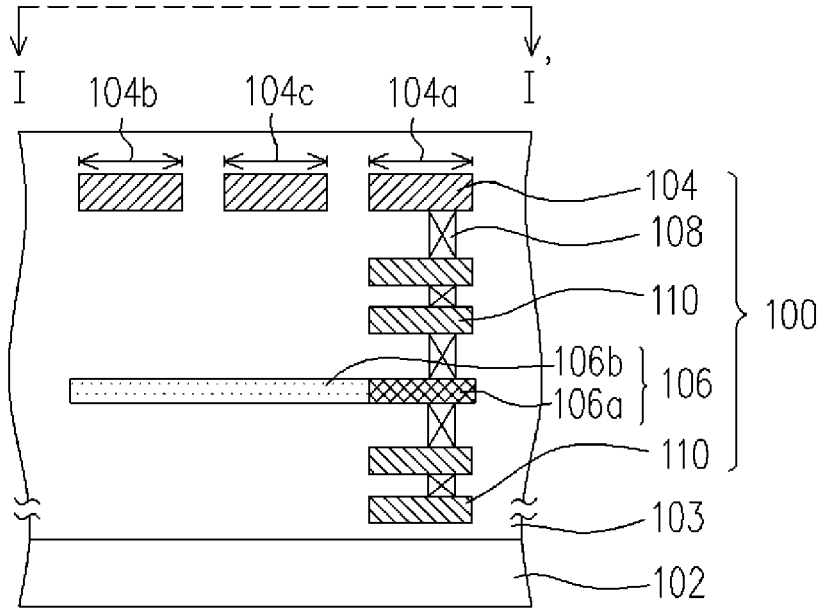
FIG. 2C is schematic sectional views taken along the sectional line I-I' of FIG. 1A according to a fourth embodiment of the present invention.

FIG. 2A is schematic sectional views taken along the sectional line I-I' of FIG. 1A according to a second embodiment of the present invention. FIG. 2B is schematic sectional views taken along the sectional line I-I' of FIG. 1A according to a third embodiment of the present invention. FIG. 2C is schematic sectional views taken along the sectional line I-I' of FIG. 1A according to a fourth embodiment of the present invention.

Referring to FIG. 2A, the inductor structure 100 further includes at least one gain lead 110. The material of the gain lead 110 is metal, such as Cu or Al—Cu alloy. The gain lead 110 is, for example, disposed in the dielectric layer 103 between the winding turn layer 104 and the first pattern 106*a* at the position of the projection of the inner turn 104*a*, so as to make the first turn starting from the end 105*a* (i.e., the inner turn 104*a*) projected onto the gain lead 110. The gain lead 110 is, for example, connected in parallel with the winding turn layer 104 and the first pattern 106*a* through the vias 108.

Referring to FIGS. 2B and 2C, the gain lead 110 can also be disposed in the dielectric layer 103 between the first pattern 106*a* and the substrate 102 (as shown in FIG. 2B), or disposed in the dielectric layer 103 between the winding turn layer 104 and the first pattern 106*a* and in the dielectric layer 103 between the first pattern 106*a* and the substrate 102 simultaneously (as shown in FIG. 2C).

In view of the above, the gain lead 110 is added between the winding turn layer 104 and the substrate 102, so as to increase the cross-section area of the metal in the inductor structure 100 by stacking the gain lead 110, thereby effectively reducing the conductor loss, and improving the quality of the inductor. Therefore, as for the performance of the inductor, the gain lead 110 has a gain effect. Moreover, in this embodiment, the interference of the substrate 102 to the inductor structure 100 mainly is that the parasitic capacitance will be generated between the outer turn 104*b* and the substrate 102, and the parasitic capacitance between the outer turn 104*b* and the substrate 102 can be reduced through the configuration of the shielding layer 106. In another aspect, as the winding turn layer 104 is grounded through the inner turn 104*a*, the parasitic capacitance generated between the inner turn 104*a* with a lower electric field and the substrate 102 is small, thus making the loss of the inductor quality of the inductor structure 100 rather small.

Figure 3A:
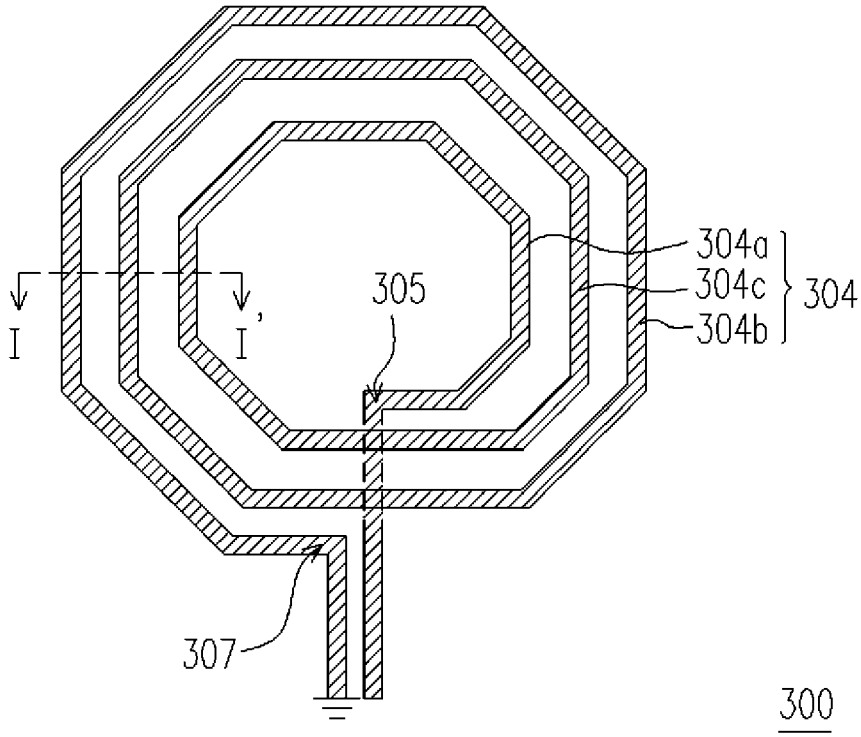
FIG. 3A is a top view of an inductor structure according to a fifth embodiment of the present invention.
Figure 3B:
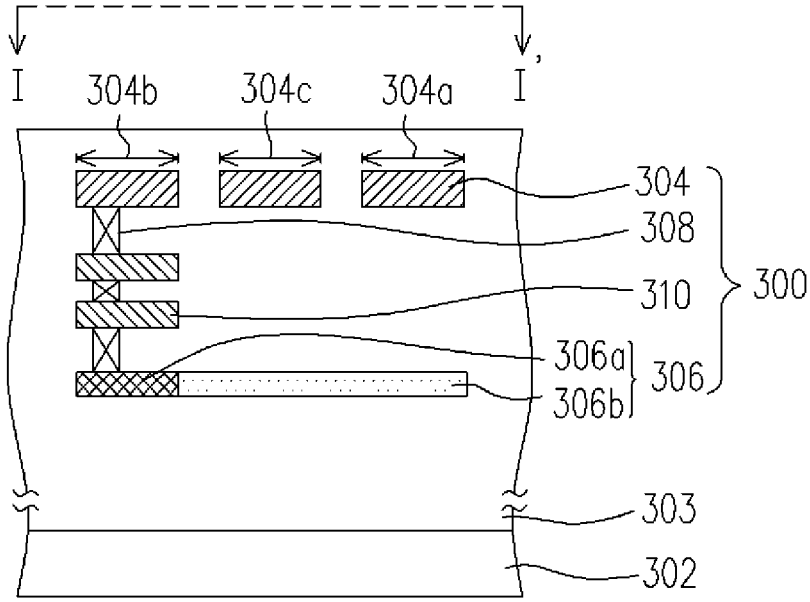
FIG. 3B is a schematic sectional view taken along a sectional line I-I' of FIG. 3A.

FIG. 3A is a top view of an inductor structure according to a fifth embodiment of the present invention. FIG. 3B is a schematic sectional view taken along a sectional line I-I' of FIG. 3A.

The present invention further provides an inductor structure. Referring to FIGS. 3A and 3B together, in another embodiment, an inductor structure 300 is disposed in a dielectric layer 303 above the substrate 302. The main difference between the inductor structure 300 and the inductor structure 100 is that, in the inductor structure 300, an end 305 of a winding turn 304 (i.e., an end of an inner turn 304*a*) is, for example, electrically coupled to an operating voltage, and the other end 307 of the winding turn 304 (i.e., an end of an outer turn 304*b*) is, for example, grounded. Moreover, in a shielding pattern 306, the first pattern 306*a* is disposed below the winding turn 304 at the position of the projection of the outer turn (grounded turn) 304*b*, so as to make the first turn (i.e., the outer turn 304*b*) starting from the end 307 projected onto the first pattern 306*a*. Further, the first pattern 306*a* is connected in parallel with the outer turn 304*b* through vias 308. The second pattern 306*b* is next to the inner edge of the first pattern 306*a*, and at least one portion of the winding turn 304 is projected onto the second pattern 306*b*. For example, a second turn (i.e., an intermediate turn 304*c*) starting from the end 307 is projected onto the second pattern 306*b*. In this embodiment, the winding turn 304 is completely projected onto the shielding pattern 306. Under such circumstance, the shielding effect of the shielding pattern 306 between the inductor structure 300 and the substrate 302 is better.

In view of the above, as shown in FIG. 3B, the inductor structure 300 can further include at least one gain lead 310. In an embodiment, the gain lead 310 can be, for example, disposed in the dielectric layer 303 between the winding turn 304 and the first pattern 306*a* at the position of the projection of the outer turn 304*b*. The gain lead 310 is, for example, connected in parallel with the winding turn 304 and the first pattern 306*a* through the vias 308. Certainly, in other embodiments, the gain lead 310 can also be disposed in the dielectric layer 303 (not shown) between the first pattern 306*a* and the substrate 302 at the position of the projection of the outer turn 304*b*, or disposed in the dielectric layer 303 (not shown) between the winding turn 304 and the first pattern 306*a* and that between the first pattern 306*a* and the substrate 302 simultaneously.

Seen from the above, when the inductor structure 100 is grounded through the inner turn 104*a*, the shielding layer 106 extends outward from the center (as shown in FIG. 1C). When the inner turn 104*a* is grounded, as the electric field of the grounded inner turn 104*a* is low, the parasitic capacitance generated between the inner turn 104*a* and the substrate 102 is small, thereby reducing the influence on the quality of the inductor structure 100. Moreover, as for the outer turn 104*b* with a stronger electric field, through the configuration of the shielding layer 106, the occurrence of the parasitic capacitance generated between the substrate 102 and the inductor structure 100 can be reduced to further raise the value of Q of the inductor.

In another aspect, when the inductor structure 300 is grounded through the outer turn 304*b*, the shielding pattern 306 extends from the periphery to the interior (as shown in FIG. 3B). When the outer turn 304*b* is grounded, as the electric field of the grounded outer turn 304*b* is low, the parasitic capacitance generated between the outer turn 304*b* and the substrate 302 is small, thereby reducing the influence on the quality of the inductor structure 300. Additionally, as for the inner turn 304*a* with a stronger electric field, through the configuration of the shielding pattern 306, the occurrence of the parasitic capacitance generated between the substrate 302 and the inductor structure 300 can be reduced to further raise the value of Q of the inductor.

Figure 4:
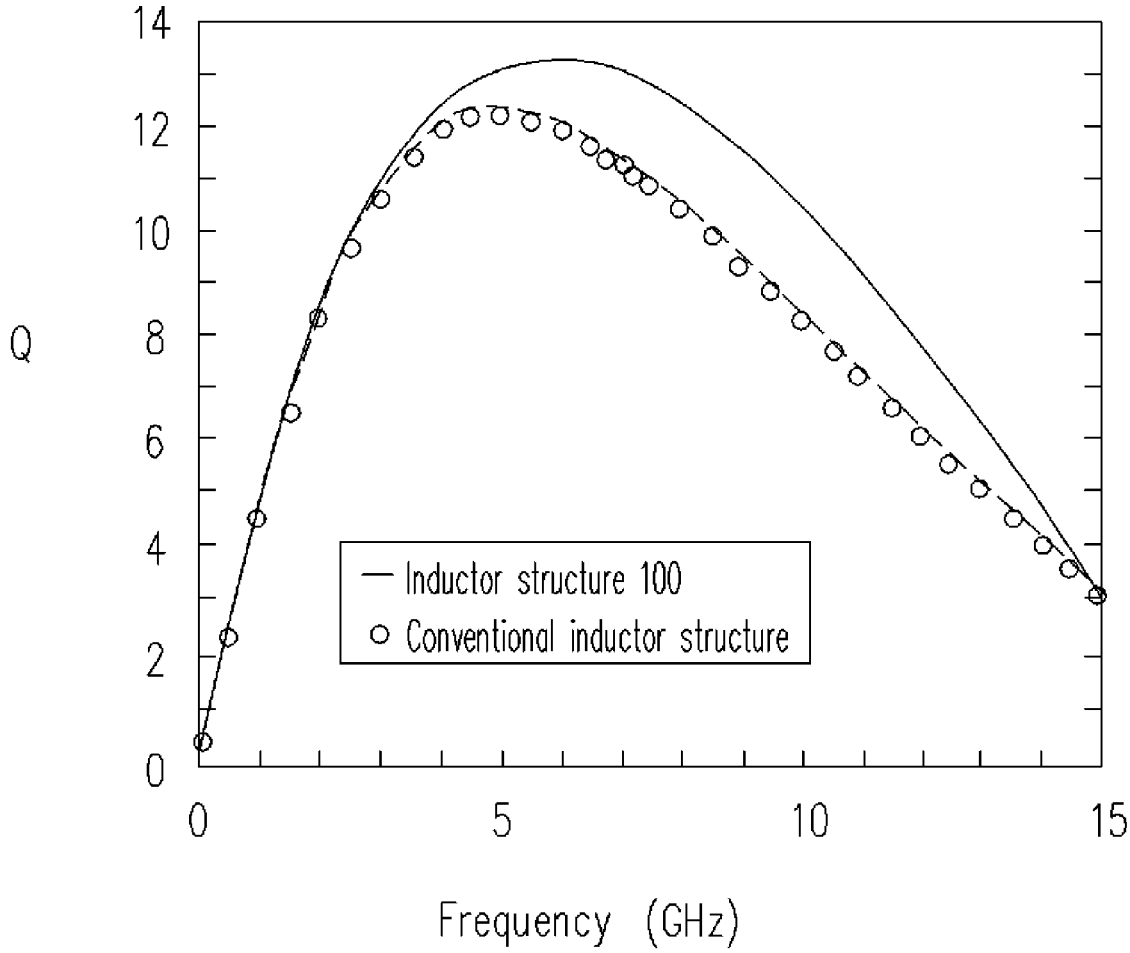
FIG. 4 is a comparison curve diagram of the value of Q between an inductor structure 100 of the present invention and a conventional inductor structure.

FIG. 4 is a comparison curve diagram of the value of Q between the inductor structure 100 of the present invention and a conventional inductor structure.

Referring to FIG. 4, seen from the result of a practical testing, the maximum value of Q of the inductor structure 100 of the present invention (the corresponding frequency is 6 GHz) is higher than that of the conventional inductor structure (the corresponding frequency of 5.1 GHz). Further, in the frequency range of 0-15 GHz shown in FIG. 4, the value of Q of the inductor structure 100 of the present invention is more preferred than that of the conventional inductor structure. Therefore, the present invention can actually expand the usable frequency range and raise the value of Q of the inductor.

Figure 5A:
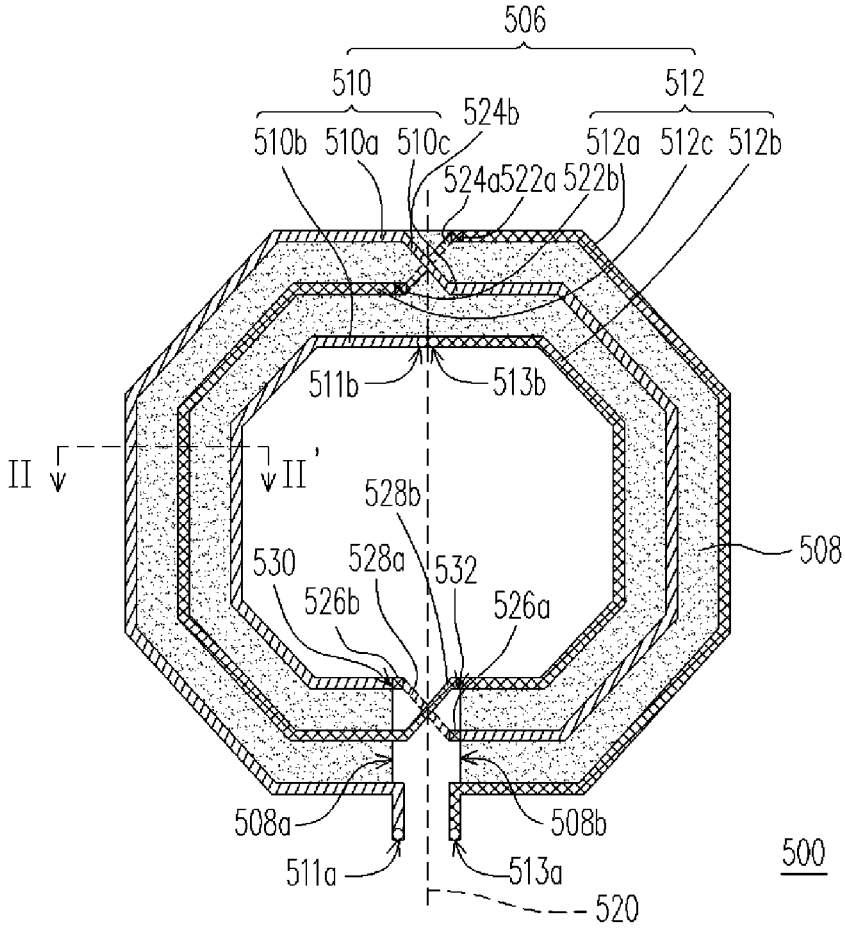
FIG. 5A is a schematic top view of an inductor structure according to a sixth embodiment of the present invention.
Figure 5B:
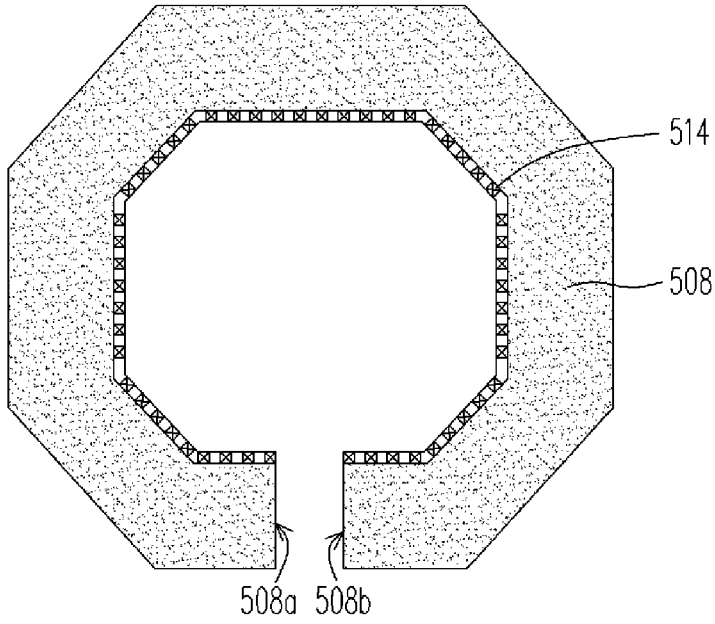
FIG. 5B is a schematic top view of a shielding layer according to the sixth embodiment of the present invention.
Figure 5C:
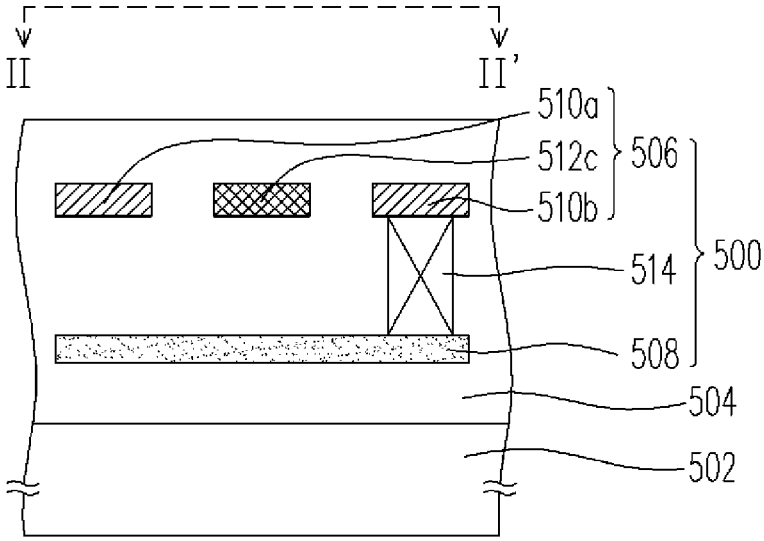
FIG. 5C is a schematic sectional view taken along a sectional line II-II' of FIG. 5A.
Figure 5D:
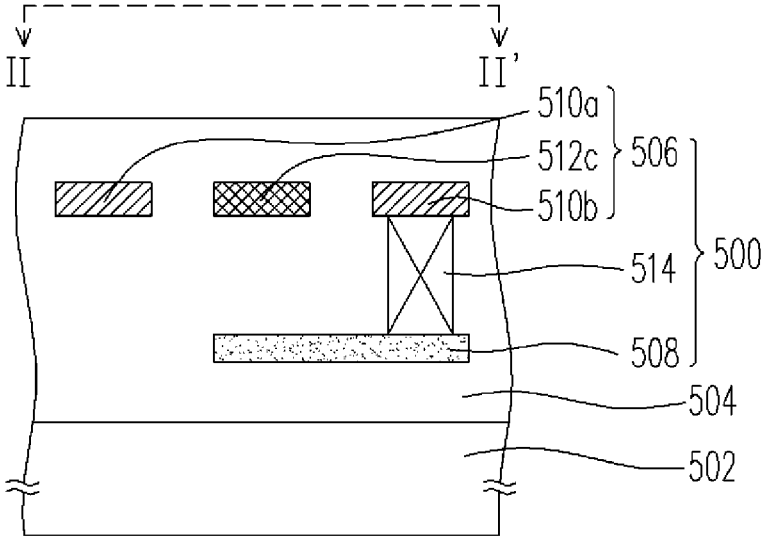
FIG. 5D is a schematic sectional view taken along the sectional line II-II' of FIG. 5A according to a seventh embodiment of the present invention.

Next, another inductor structure provided by the present invention is described. FIG. 5A is a schematic top view of an inductor structure according to a sixth embodiment of the present invention. FIG. 5B is a schematic top view of a shielding layer according to the sixth embodiment of the present invention. FIG. 5C is a schematic sectional view taken along a sectional line II-II' of FIG. 5A. FIG. 5D is a schematic sectional view taken along the sectional line II-II' of FIG. 5A according to a seventh embodiment of the present invention.

Referring to FIGS. 5A, 5B, and 5C together, the inductor structure 500 includes a winding turn layer 506 and a shielding layer 508. The winding turn layer 506 is disposed in a dielectric layer 504 on a substrate 502. The shielding layer 508 is disposed in the dielectric layer 504 between the winding turn layer 506 and the substrate 502. As the inductor structure 500 can be realized with a semiconductor process, the substrate 502 can be a silicon substrate. The material of the dielectric layer 504 is, for example, silicon oxide or other dielectric materials. The material of the winding turn layer 506 can be metal, such as Cu or Al—Cu alloy. The material of the shielding layer 508 can be conductive materials, such as polysilicon or metal. In addition, in this embodiment, the inductor structure 500 is in the shape of an octagon (as shown in FIG. 5A), but the shape of the inductor structure of the present invention is not limited to the shape shown in the embodiments.

The winding turn layer 506 includes a helical lead 510 and a helical lead 512, in which the helical lead 510 and the helical lead 512 are, for example, disposed at a plane of the same height. The winding turn layer 506, for example, has a symmetrical helical circular structure having a plurality of turns. That is, the helical lead 510 and the helical lead 512, for example, wind with each other in mirror configuration about the symmetrical plane 520, in which the symmetrical plane 520 extends, for example, inward the page.

The helical lead 510 at least includes an outer lead 510*a* and an inner lead 510*b*, in which the outer lead 510*a* is serially connected with the inner lead 510*b*. The helical lead 510 has a first end 511*a* and a second end 511*b*. The first end 511*a* is, for example, an end point of the outer lead 510*a*, and the second end is, for example, an end point of the inner lead 510*b*. That is, the first end 511*a* is disposed outside the helical lead 510, and the second end 511*b* rotates in helical fashion towards a central portion of a helical structure of the helical lead 510.

The helical lead 512 winds with the helical lead 510 about the symmetrical plane 520. The helical lead 512 at least includes an outer lead 512*a* and an inner lead 512*b*, and the outer lead 512*a* is serially connected with the inner lead 512*b*. The helical lead 512 has a third end 513*a* and a fourth end 513*b*. The third end 513*a* is, for example, an end point of the outer lead 512*a*, and the fourth end 513*b* is, for example, an end point of the inner lead 512*b*. The third end 513*a* is, for example, disposed outside the helical lead 512 corresponding to the position of the first end 511*a*. The fourth end 513*b*, for example, rotates to in helical fashion towards a central portion of a helical structure of the helical lead 512 corresponding to the position of the second end 511*b*. The second end 511*b* is connected to the fourth end 513*b* on the symmetrical plane 520. That is, the helical lead 510 and the helical lead 512 are cross-connected to the innermost turn of the winding turn layer 506.

As shown in FIG. 5A, in this embodiment, the winding turn layer 506 of the inductor structure 500, for example, has a three-turn structure. Thus, the helical lead 510 and the helical lead 512 respectively can further include a connection lead 510*c* and a connection lead 512*c*. The outer lead 510*a* is serially connected with the inner lead 510*b*, for example, through the connection lead 510*c*. The outer lead 512*a* is serially connected with the inner lead 512*b*, for example, through the connection lead 512*c*. However, the number of the turns of the winding turn layer 506 is not limited to three of this embodiment, and the aforementioned connection method is not intended to limit the present invention.

Under the circumstance that the winding turn layer 506 has a two-turn structure, the outer lead 510*a* is serially connected with the inner lead 510*b* directly, and it is the same with the outer lead 512*a* and the inner lead 512*b*. Of course, a plurality of turns of connection leads 510*c* can be disposed between the outer lead 510*a* and the inner lead 510*b* in the winding turn layer 506, and a plurality of turns of connection leads 512*c* is disposed between the outer lead 512*a* and the inner lead 512*b* correspondingly, such that the winding turn layer 506 is in a structure having more than three turns. Persons of ordinary skill in the art can make appropriate adjustments on demands.

Continue referring to FIG. 5A. The helical lead 510 and the helical lead 512 wind with each other by means of, for example, interlacing the helical lead 510 and the helical lead 512 on the symmetrical plane 520. The helical lead 510 and the helical lead 512 do not contact with each other at the interlacing position, so as to prevent a short circuit. For example, in the helical lead 512, the outer lead 512*a* is, for example, connected downward to a bonding lead 524*a* through a via 522*a*, and connected to the connection lead 512*c* through a via 522*b*, such that the helical lead 512 can pass from below the helical lead 510 at the interlacing position to avoid contacting the helical leads 510 and 512. The outer lead 510*a* is connected to the connection lead 510*c* through a bonding lead 524*b* on a plane of the same height. In another aspect, in the helical lead 510, the connection lead 510*c* is connected to the inner lead 510*b*, for example, through the vias 526*a*, 526*b*, and the bonding lead 528*a*, such that the helical lead 510 passes from below the helical lead 512 at the interlacing position. The connection lead 512*c* is connected to the inner lead 512*b* through a bonding lead 528*b* on a plane of the same height.

In view of the above, on operating the inductor structure 500, for example, an operating voltage is applied on the first end 511*a* and the third end 513*a* at the same time. As the voltage applied on the first end 511*a* and the voltage applied on the third end 513*a* have an equal absolute value but opposite electrical properties, from the first end 511*a* and the third end 513*a*. That is, the inductor structure 500 is applied in a symmetrical differential inductor structure. Furthermore, the absolute value of the voltage gradually reduces toward the interior of the helical lead 510 and the helical lead 512. The voltage value at the junction of the second end 511*b* of the inner lead 510*b* and the fourth end 513*b* of the inner lead 512*b* is 0. That is, the innermost turn of the winding turn layer 506 is virtually grounded.

Continue referring to FIGS. 5A, 5B, and 5C. The shielding layer 508 is disposed between the winding turn layer 506 and the substrate 502 at the projection of the innermost turn of the winding turn layer 506. In this embodiment, the inner lead 510*b* and the inner lead 512*b* are projected onto the shielding layer 508. The shielding layer 508, for example, has a gap, and is in an incomplete annular structure. The shielding layer 508 has an end 508*a* and an end 508*b* at the gap. Moreover, the shielding layer 508 is electrically coupled to the innermost turn of the winding turn layer 506, for example, in parallel. In this embodiment, for example, at least two vias 514 are disposed between the winding turn layer 506 and the shielding layer 508, such that the end 508*a* and the end 508*b* of the shielding layer 508 are respectively coupled to the end 530 of the inner lead 510*b* and the end 532 of the inner lead 512*b*. Thus, the shielding layer 508 can serve as a self-shielding structure of the inductor structure 500.

In view of the above, referring to FIGS. 5C and 5D together, besides the innermost turn (the inner lead 510*b* and the inner lead 512*b*), at least parts of the winding turn layer 506 are also projected onto the shielding layer 508. That is, the whole winding turn layer 506 is completely projected onto the shielding layer 508 (as shown in FIG. 5C); or the innermost two turns of the winding turn layer 506 are projected onto the shielding layer 508 (as shown in FIG. 5D). Further, the parasitic capacitance generated between the substrate 502 and the winding turn layer 506 can be reduced as long as the shielding layer 508 shields a part of the winding turn layer 506, so as to improve the quality of the inductor. As shown in FIG. 5C, under the circumstance that the winding turn layer 506 is completely projected onto the shielding layer 508, the shielding layer 508 can have a better shielding effect between the inductor structure 500 and the substrate 502.

Figure 5E:
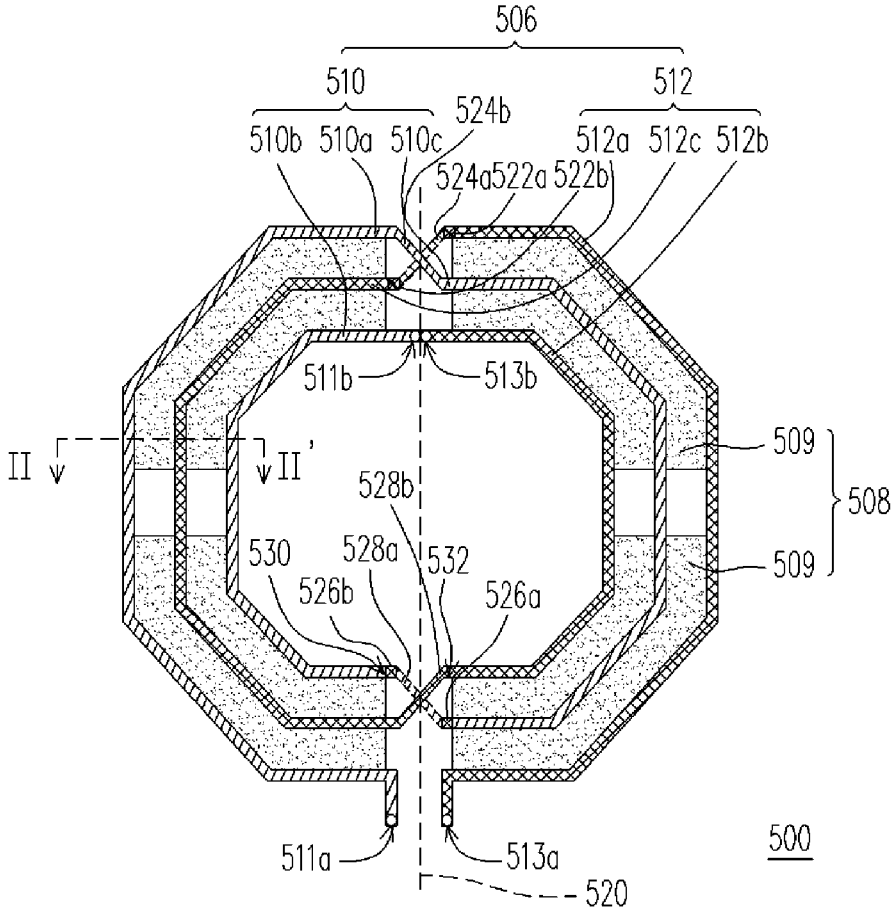
FIG. 5E is a schematic top view of an inductor structure according to an eighth embodiment of the present invention.
Figure 5F:
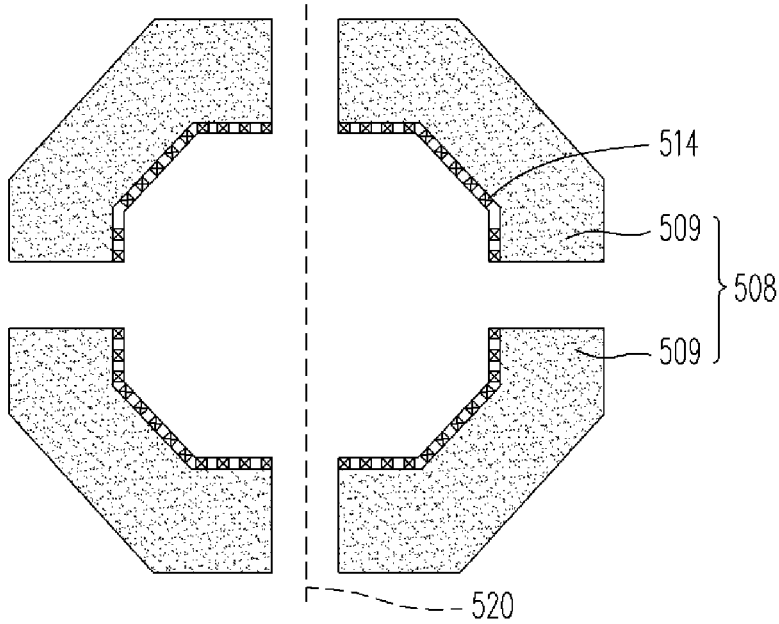
FIG. 5F is a schematic top view of a shielding layer according to the eighth embodiment of the present invention.

FIG. 5E is a schematic top view of an inductor structure according to an eighth embodiment of the present invention. FIG. 5F is a schematic top view of a shielding layer according to the eighth embodiment of the present invention. In FIGS. 5E and 5F, the components identical to those in FIGS. 5A and 5B are represented by the same reference numbers and the descriptions thereof are omitted.

Referring to FIGS. 5E and 5F together, the shielding layer 508 can, for example, include more than two shielding patterns 509. As shown in FIG. 5F, the shielding layer 508 includes four shielding patterns 509, and the shielding patterns 509 are disposed, for example, in mirror configuration on both sides of the symmetrical plane 520. Moreover, each shielding pattern 509 is connected in parallel with the innermost turn of the winding turn layer 506 by means of, for example, respectively connecting the two ends of each shielding pattern 509 to the inner lead 510*b* or the inner lead 512*b* through at least two vias 514. In the above embodiment, the shielding layer 508 having four shielding patterns 509 is taken as an example, but the present invention is not limited thereto. In other embodiments, the shielding layer 508 can include more than one symmetrically disposed shielding pattern 509, as long as each shielding pattern 509 is connected in parallel with the innermost turn of the winding turn layer 506.

It should be noted that, in the winding turn layer 506, the absolute value of the voltage gradually reduces toward the interior of the winding turn layer 506. That is, the innermost turn of the winding turn layer 506 has a low electric field. As the shielding layer 508 is connected in parallel with the innermost turn of the winding turn layer 506, the shielding layer 508 has an electric field property similar to that of the innermost turn of the winding turn layer 506. Thus, the parasitic capacitance generated between the shielding layer 508 and the substrate 502 can be ignored. The outmost turn of the winding turn layer 506 that can generate a large electric field under a large voltage can be blocked by the shielding layer 508 between the winding turn layer 506 and the substrate 502, thus reducing the energy loss. Therefore, the present invention can reduce the parasitic capacitance generated between the substrate 502 and the inductor structure 500, so as to reduce the resistance caused by the substrate 502, thereby raising the value of Q of the inductor structure 500.

Figure 6A:
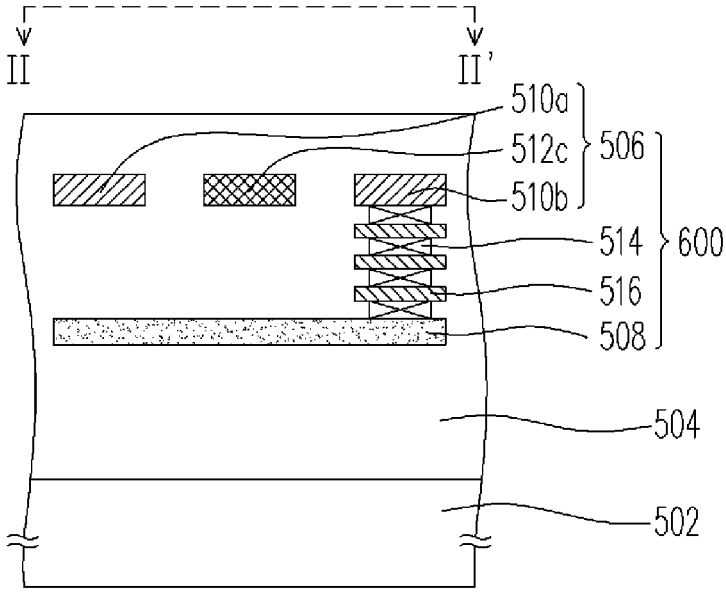
FIG. 6A is schematic sectional views taken along the sectional line II-II' of FIG. 5A according to a ninth embodiment of the present invention.
Figure 6B:
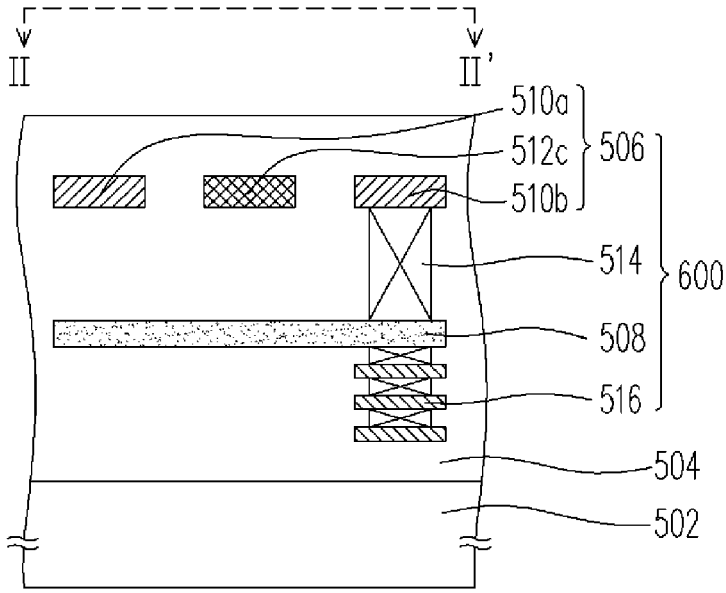
FIG. 6B is schematic sectional views taken along the sectional line II-II' of FIG. 5A according to a tenth embodiment of the present invention.
Figure 6C:
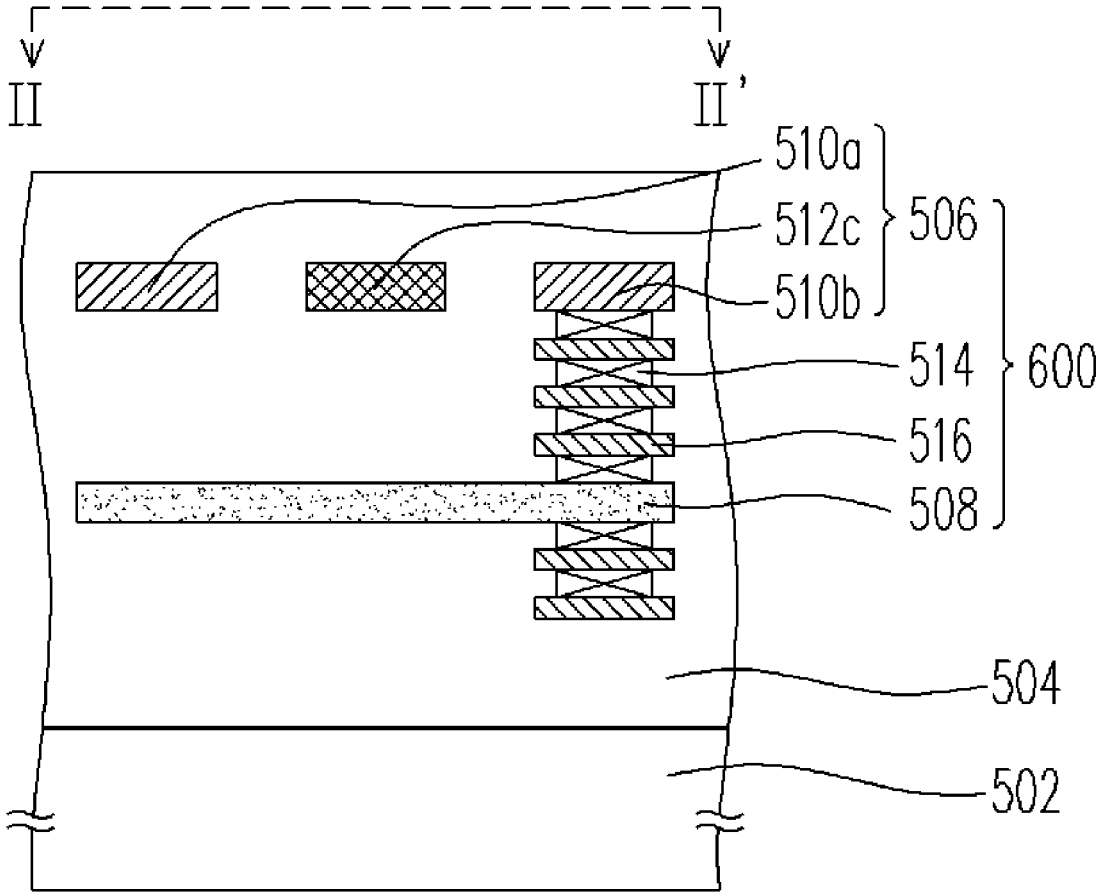
FIG. 6C is schematic sectional views taken along the sectional line II-II' of FIG. 5A according to an eleventh embodiment of the present invention.

FIG. 6A is schematic sectional views taken along the sectional line II-II' of FIG. 5A according to a ninth embodiment of the present invention. FIG. 6B is schematic sectional views taken along the sectional line II-II' of FIG. 5A according to a tenth embodiment of the present invention. FIG. 6C is schematic sectional views taken along the sectional line II-II' of FIG. 5A according to an eleventh embodiment of the present invention. In FIGS. 6A-6C, the components identical to those in FIGS. 5A-5C are represented by the same reference numbers and the descriptions thereof are omitted.

The present invention further provides an inductor structure. Referring to FIG. 6A, the inductor structure 600 is, for example, disposed in the dielectric layer 504 above the substrate 502. In this embodiment, the components forming the inductor structure 600 are similar to those forming the inductor structure 500, and the major difference is that: the inductor structure 600 further includes at least one gain lead 516. The gain lead 516 is, for example, disposed between the winding turn layer 506 and the shielding layer 508 corresponding to the innermost turn of the winding turn layer 506.

In view of the above, the gain lead 516 is, for example, respectively coupled to the innermost turn of the winding turn layer 506 and the shielding layer 508. The coupling method is, for example, respectively connecting the two ends of the gain lead 516 in parallel with the end 530 of the inner lead 510*b* and the end 532 of the inner lead 512*b* through at least two vias 514; and connecting the two ends of the gain lead in parallel with the end 508*a* and the end 508*b* of the shielding layer 508 through at least two vias 514. Moreover, under the circumstance that there are several gain leads 516 (for example, three in FIG. 6A), the up-and-down adjacent gain leads 516 are connected in parallel with each other through, for example, a plurality of vias 514. The material of the gain leads 516 can be metal, such as Cu or Al—Cu alloy.

Referring to FIGS. 6B and 6C together, the gain leads 516 can be disposed between the shielding layer 508 and the substrate 502 corresponding to the innermost turn of the winding turn layer 506 (as show in FIG. 6B), or the gain leads 516 can be disposed between the winding turn layer 506 and the shielding layer 508 and between the shielding layer 508 and the substrate 502 at the same time (as shown in FIG. 6C).

It should be noted that, the gain leads 516 are disposed between the winding turn layer 506 and the substrate 502, such that the cross-section area of the inductor structure 600 can be increased through the stacked gain leads 516, so as to effectively alleviate the conductor loss. Moreover, as the gain leads 516 are connected in parallel with the innermost turn of the winding turn layer 506, the gain leads 516 will have the electric field property similar to the innermost turn of the shielding layer 506. That is, the electric field of the gain leads 516 is low, which can raise the cross-section area without increasing the parasitic capacitance generated between metal and metal. Therefore, the inductor structure 600 can have a better quality.

Figure 7:
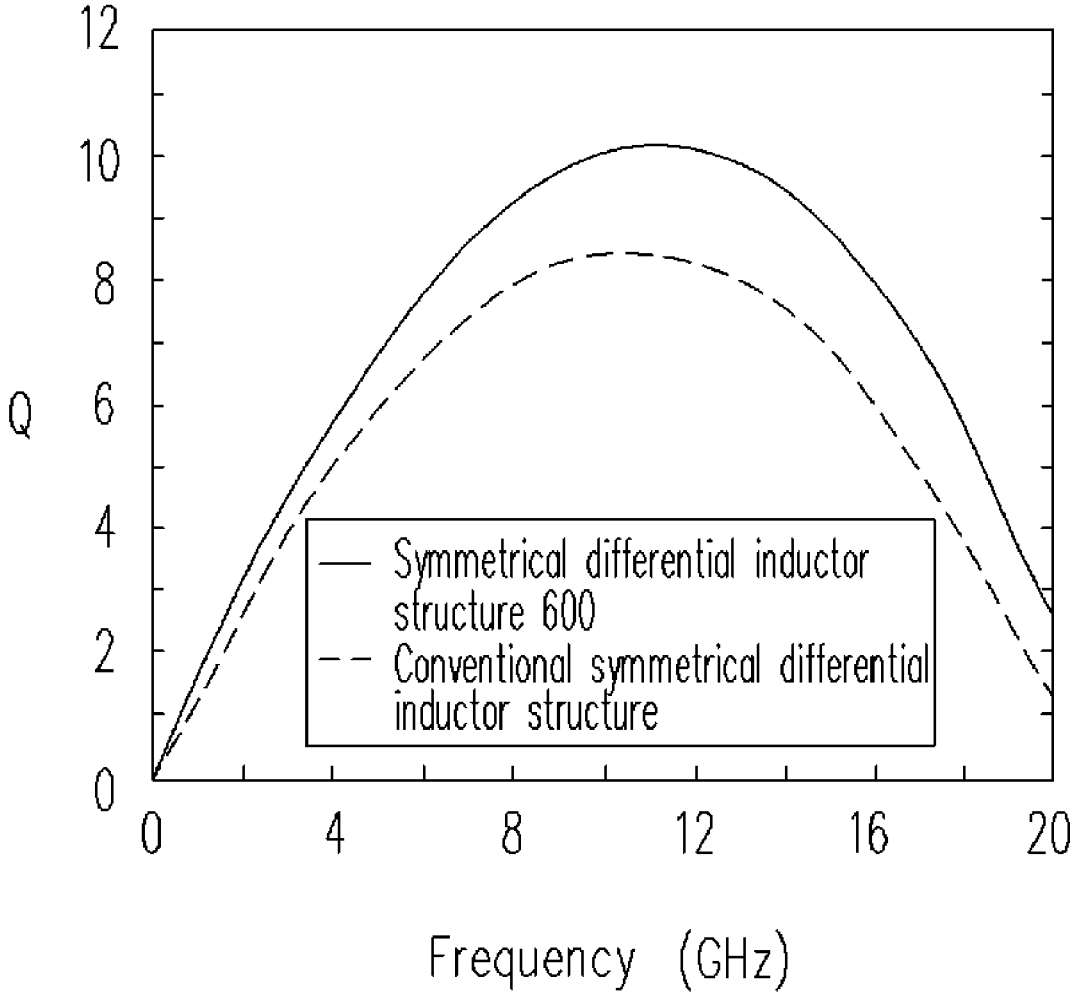
FIG. 7 is a comparison curve diagram of the value of Q between an inductor structure 600 of the present invention and a conventional inductor structure.

FIG. 7 is a comparison curve diagram of the value of Q between the inductor structure 600 of the present invention and a conventional inductor structure, wherein these two inductor structures are symmetrical differential inductor structures.

Referring to FIG. 7, seen from the result of a practical testing, in a frequency range from 0-20 GHz, the inductor structure 600 of the present invention has a value of Q higher than that of the conventional inductor structure. Thus, no matter in a low or high frequency range, the present invention can actually improve the quality of the inductor structure and further expand the usable frequency range.

To sum up, in the inductor structure of the present invention, the winding turn layer and the substrate are blocked by a shielding layer, so as to reduce the parasitic capacitance generated between the substrate and the winding turn layer, thus reducing the energy loss and improving the quality of the inductor. Moreover, as the shielding layer is connected in parallel with the grounded turn having a low electric field of the winding turn layer, the parasitic effect generated between the shielding layer and the substrate can be ignored.

Moreover, if a gain lead is disposed between the winding turn layer and the substrate in the inductor structure of the present invention, the cross-section area can be increased to effectively reduce the conductor loss, so as to improve the performance of the inductor. Besides, the gain lead is connected in parallel with the grounded turn of the winding turn layer, such that the parasitic capacitance can be avoided from being generated between metal and metal, thus improving the value of Q of the inductor.

In addition, the applicable frequency range of the inductor structure of the present invention can remain within the range for an RF circuit, and the fabrication process of the inductor structure can be integrated into the existing process, which helps to reduce the cost of the process.

Though the present invention has been disclosed above by the above embodiments, they are not intended to limit the present invention. Persons skilled in the art can make some modifications and variations without departing from the spirit and scope of the present invention. Therefore, the protecting range of the present invention falls in the appended claims.

What is claimed is:

1. An inductor structure, comprising:

a winding turn layer, disposed above a substrate, formed by serially connecting a plurality of turns, and having a first end and a second end, wherein the first end is grounded;

a shielding layer, disposed between the winding turn layer and the substrate, and having a third end and a fourth end, wherein at least two turns starting from the first end of the winding turn layer are projected onto the shielding layer; and a plurality of first vias, disposed between the winding turn layer and the shielding layer, so as to at least make the third end and the fourth end of the shielding layer electrically connected to a first turn of the winding turn layer, wherein the first turn is starting from the first end, and the winding turn layer and the shielding layer are electrically coupled in parallel.

2. The inductor structure as claimed in claim 1, further comprising at least one gain lead, disposed between the winding turn layer and the shielding layer at the projection of the first turn, and connected in parallel with the winding turn layer and the shielding layer.

3. The inductor structure as claimed in claim 2, further comprising at least four second vias, so as to make an end of the gain lead respectively coupled to ends of the shielding layer and the first turn, and make the other end of the gain lead respectively coupled to the other ends of the shielding layer and the first turn.

4. The inductor structure as claimed in claim 1, further comprising at least one gain lead, disposed between the shielding layer and the substrate at the projection of the first turn, and connected in parallel with the shielding layer.

5. The inductor structure as claimed in claim 4, further comprising at least two second vias, so as to make an end of the gain lead coupled to an end of the shielding layer, and make the other end of the gain lead coupled to the other end of the shielding layer.

6. The inductor structure as claimed in claim 1, wherein the winding turn layer is completely projected onto the shielding layer.

* * * * *